United States Patent [19]

Ferguson et al.

[11] 4,141,094

[45] Feb. 27, 1979

[54] INCREASED MOBILITY APPARATUS FOR THE DISABLED

[75] Inventors: Andrew M. Ferguson, Merritt Island, Fla.; Ernest V. Keith, Dover, Del.; David C. Hatchell, Fairfax, Va.

[73] Assignees: Reme Enterprises, Inc., Dover, Del.; National Patent Search Associates, Inc., Arlington, Va.

[21] Appl. No.: 735,963

[22] Filed: Oct. 27, 1976

[51] Int. Cl.[2] ..... A47A 1/02; A61G 7/06; A61G 15/00

[52] U.S. Cl. ..... 5/81 R

[58] Field of Search ..... 5/81 R, 83, 84–89; 297/DIG. 10, 384, DIG. 4; 182/6; 214/77 R

[56] References Cited

U.S. PATENT DOCUMENTS

| | | | |
|---|---|---|---|
| 2,108,066 | 2/1938 | Kuhlemann | 182/6 |
| 2,793,768 | 5/1957 | Schaedler | 5/89 |
| 3,261,031 | 7/1966 | Gates | 297/DIG. 10 |
| 3,709,556 | 1/1973 | Allard et al. | 297/DIG. 4 |
| 3,757,893 | 9/1973 | Hobbs | 186/6 |
| 3,787,089 | 1/1974 | Wrethander | 297/DIG. 10 |
| 3,807,795 | 4/1974 | Weant et al. | 5/86 |
| 3,851,917 | 12/1974 | Horstmann et al. | 297/DIG. 10 |

*Primary Examiner*—Peter M. Caun

[57] ABSTRACT

Apparatus for aiding the mobility and independence of disabled persons, comprising a harness encircling the torso and upper thigh areas equipped with lifting points along the centerline and above the center of gravity of the individual, a system of lifting levers mounted on a wheelchair which attach to the harness and raise the individual along a natural path from a sitting to a standing position, and alternately, an overhead suspension system attaching to the harness and being either attached to a wheelchair or a permanently mounted fixture in a bathroom or other area to allow independent movement from a wheelchair to a bathtub, bed, automobile or the like.

25 Claims, 15 Drawing Figures

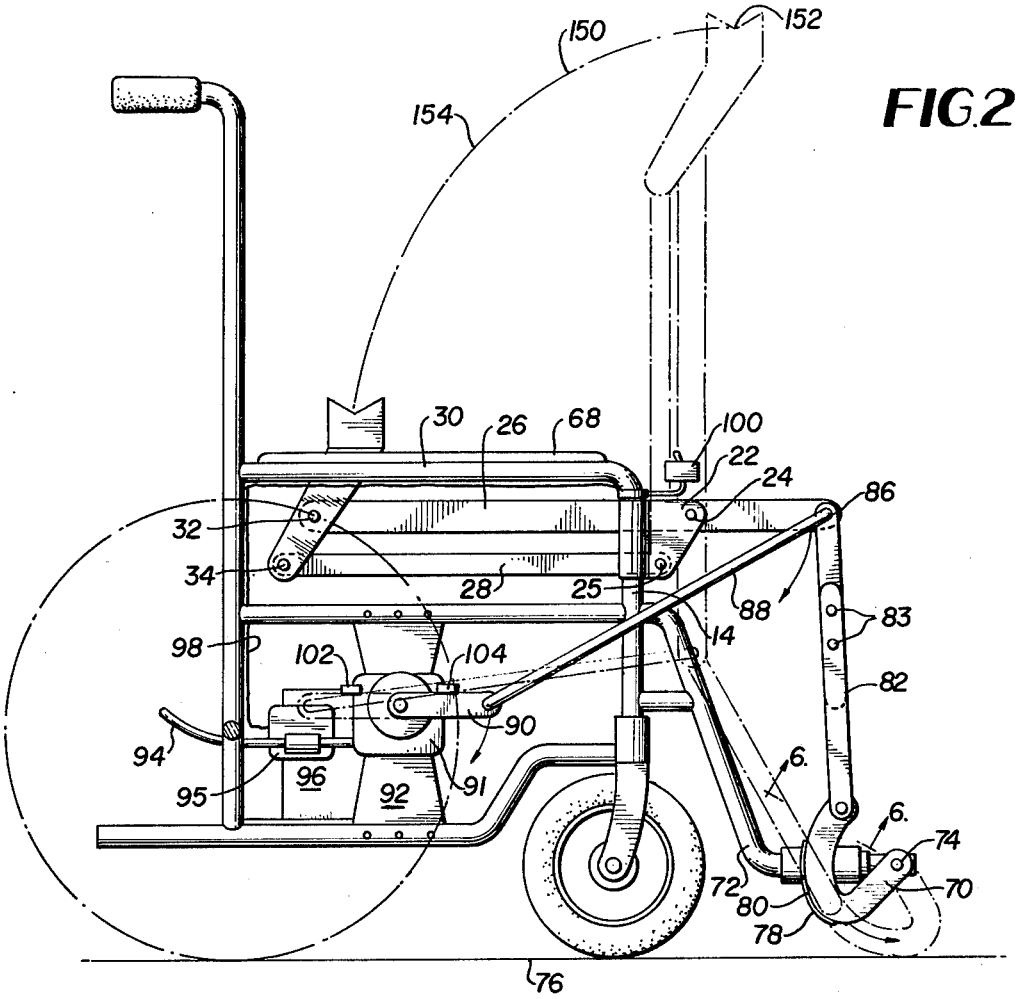
FIG.2
FIG.4
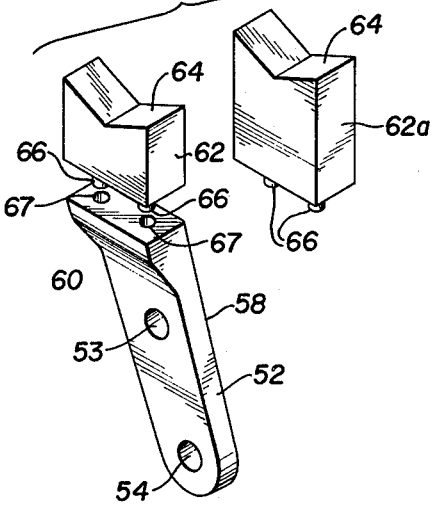
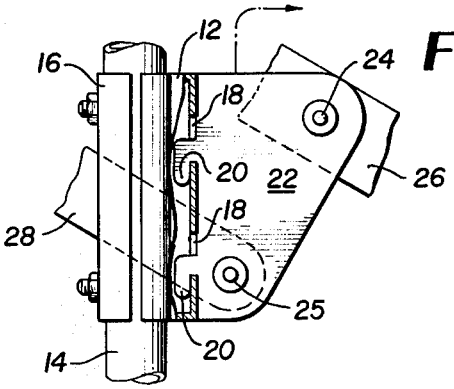
FIG.5
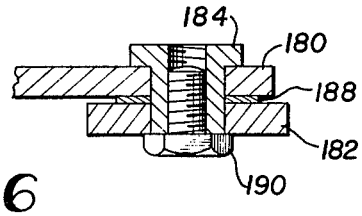
FIG.6

FIG.10
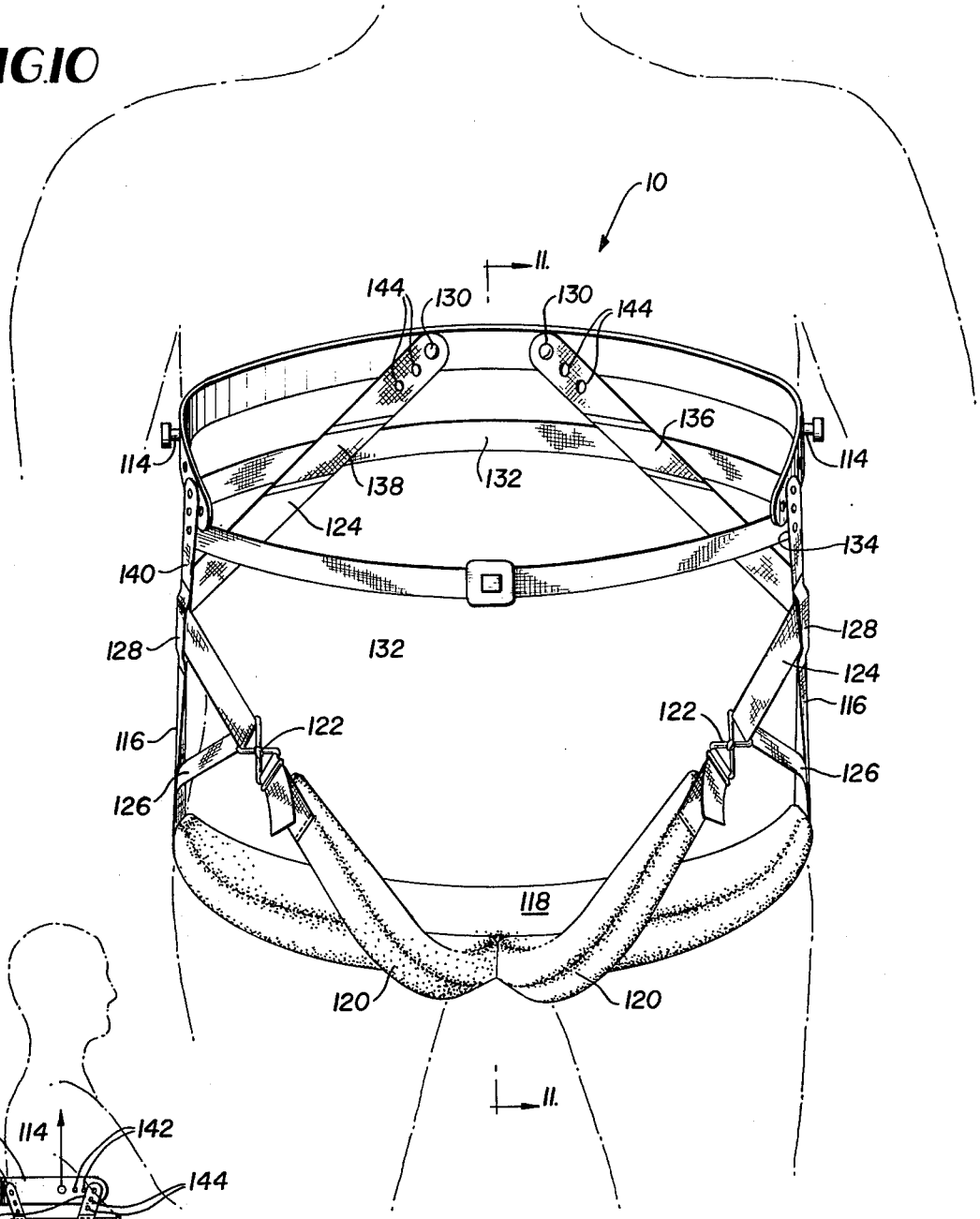
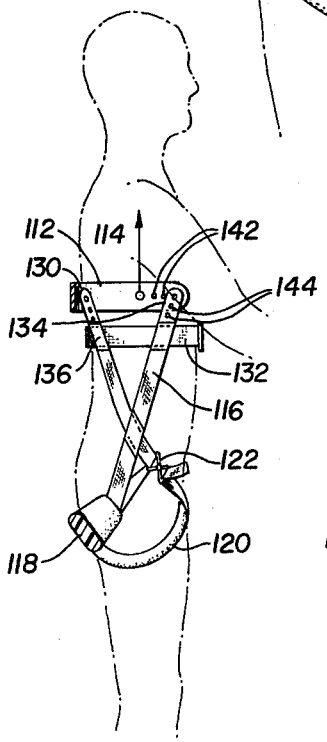
FIG.11

FIG.15
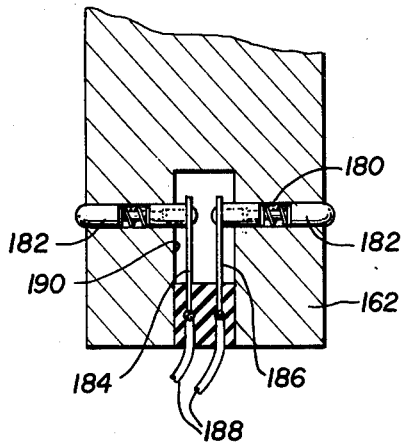
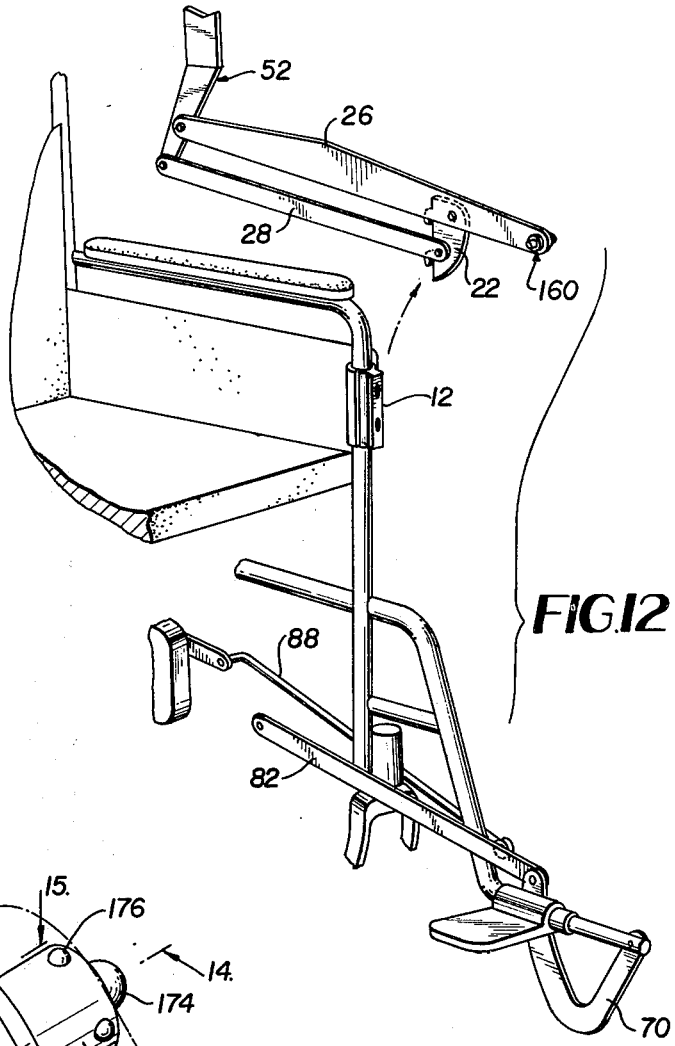
FIG.12
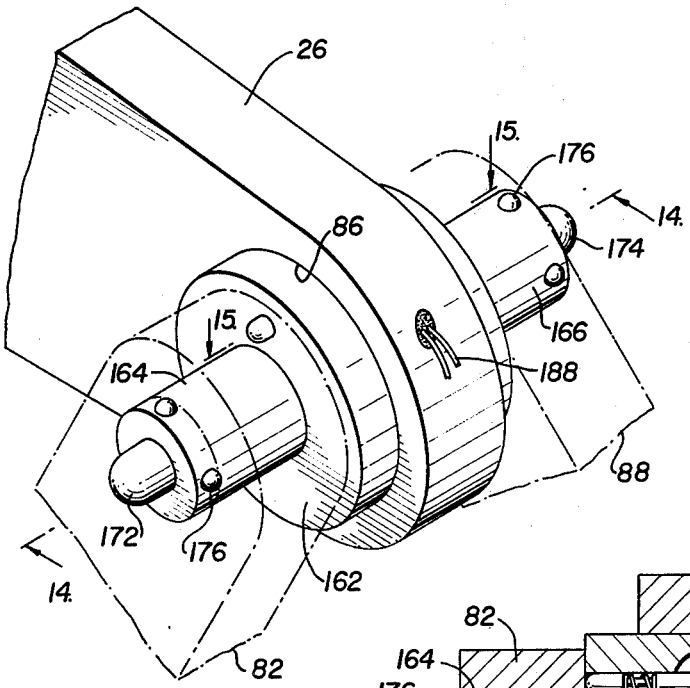
FIG.13
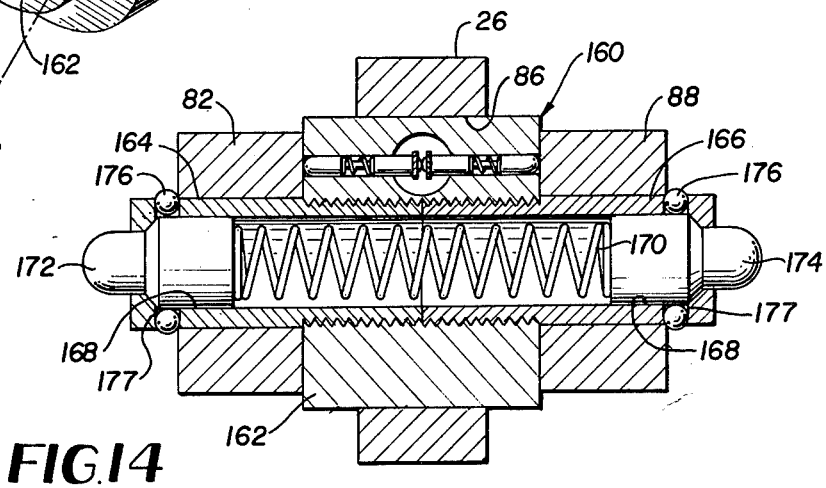
FIG.14

INCREASED MOBILITY APPARATUS FOR THE DISABLED

BACKGROUND AND SUMMARY OF THE INVENTION

Disabled persons who have lost the use of their lower limbs either by accident, disease or misadventure are normally confined to wheelchairs, these being the best currently available alternative providing a reasonable personal mobility. The limitations and disadvantages of being confined to a sitting position in a wheelchair are many. Some of the discomforts and disadvantages which most seriously affect the life of these disabled persons are pain at the base of the spine from long hours of uninterrupted sitting, inability to perform normal activities such as reaching into a closet, cooking a meal, getting into the bathtub, and inability to perform common acts of courtesy such as standing to shake hands which serve to reinforce the appearance and fact of disability.

The physical and psychological advantages of being able to perform the above mentioned activities and functions and more is hard to estimate beyond saying that it would be considerable.

To accomplish these and other ends, the present invention includes a harness which encircles the lower torso in an area between the hips and rib cage. Straps pass from the encircling harness under the upper thigh area and are connected in an area below the buttocks by a cushioned web. A rigid band passes around the back of the harness and is connected to it to prevent the harness from pinching inwardly on the torso when lift is applied. Lifting points are attached to the rigid band at a point along the centerline and above the center of gravity of the individual.

Attached to the wheelchair normally used is a system of parallel arm lifting levers and lifting brackets which mate with the lifting points on the rigid band. The lifting levers are operated by an electric motor connected to actuator arms and gearboxes. The action of the levers allows a minimum of lift to be imposed, relieving the pressure on the lower spine, or alternatively may raise the individual along a natural arc to a standing position in front of the wheelchair. Ground engaging cams or wheels provide support in front of the wheelchair to prevent tipping forward when the standing position is reached.

An alternative lifting apparatus utilizing an overhead rail attachment for the wheelchair and an overhead motor and winch drum is also provided for special cases. An overhead rail with traveling winch arrangement is provided as a fixture for mounting in a bathroom, garage or another area where additional maneuverability is desired. The traveling winch lifts on the harness by means of several alternate devices which will allow easy access by the individual to a bathtub, automobile seat or other similar areas.

Complete freedom of motion of the upper torso and arms is retained at all times when the apparatus of the present invention is in use.

BRIEF DESCRIPTION OF THE DRAWINGS

FIG. 2 is a side elevational view of a wheelchair with a main drive wheel removed for clarity, illustrating a preferred embodiment of the lifting system of the present invention in the lowered and phantom raised positions;

FIG. 4 is an exploded partial perspective view of a preferred embodiment of a lifting bracket;

FIG. 5 is an enlarged side elevational view of an attachment system for the lifting arms whereby they may be removably mounted on a wheelchair;

FIG. 6 is an enlarged partial sectional view taken substantially along line 6—6 of FIG. 2, illustrating a typical fastening system for rotating members;

FIG. 10 is a front elevational view of a preferred embodiment of a harness of the present invention;

FIG. 11 is a sectional view taken substantially along line 11—11 of FIG. 10;

FIG. 12 is a partial front perspective view of a wheelchair, illustrating the removal of the lift apparatus for ingress to the chair;

FIG. 13 is an enlarged front perspective view of a fastening system for the apparatus of the present invention;

FIG. 14 is a sectional view taken substantially along line 14—14 of FIG. 13; and FIG. 15 is a sectional view taken substantially along line 15—15 of FIG. 13.

DESCRIPTION OF THE PREFERRED EMBODIMENTS

The apparatus of the present invention is adapted to be mounted on a wheelchair 10 constructed of known materials and methods. Alternately, the present apparatus may be mounted on stationary chairs or other similarly configured appliances.

Figure 1:
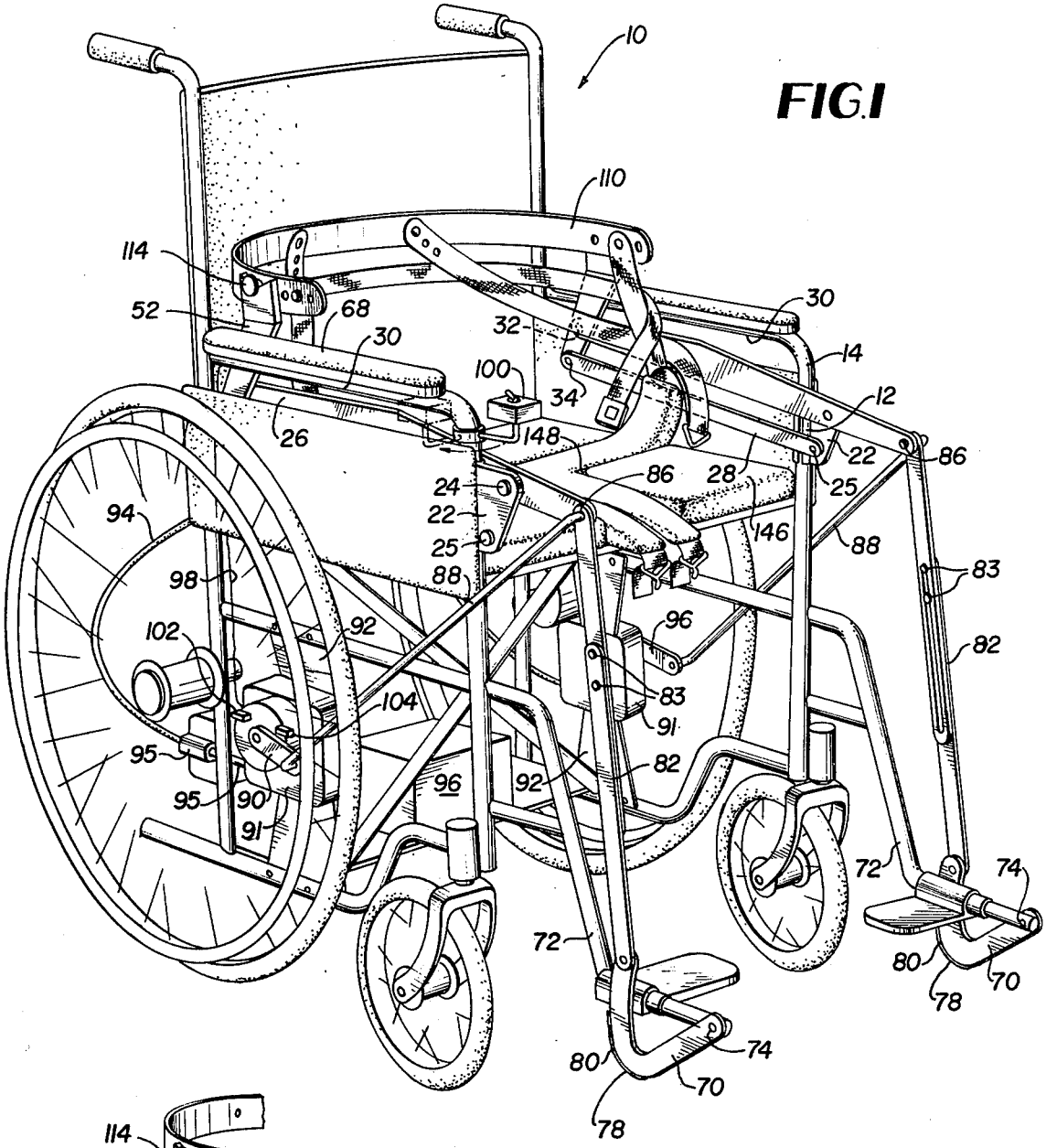
FIG. 1 is a front perspective view of a wheelchair having a preferred embodiment of the invention installed with the harness.

As shown in FIGS. 1 and 2, the apparatus of the present invention comprises attachment brackets 12 affixed to both front armrest supports 14 of the wheelchair 10 by means of clamps 16 or other suitable means preferably bolted through the front armrest supports 14. The attachment brackets 12 are provided with slots 18 or other suitable means by which they may be interlocked with mating fingers 20 on pivot plates 22, as shown in FIG. 5. The pivot plates 22 and attachment brackets 12 are preferably formed from metal of sufficient strength to accept the strains that will be imposed upon them.

The pivot plates 22 are provided with holes 24 and 25 or other suitable anchor points for rotatably mounting operating arms 26 and paralleling arms 28 on the pivot plates 22. The operating arms 26 and paralleling arms 28 are preferably formed of metal or a similar rigid material and extend inboard of the wheelchair arm framework 30 from mounting holes 24 and 25 to second mounting holes 32 and 34 located preferably slightly to the rear of the centerline of the wheelchair occupant. The paralleling arms 28 extend substantially parallel to the operating arms 26. The length of the paralleling arms 28 between holes 25 and 34 preferably is substantially the same as the length of the operating arms 26 between holes 24 and 32.

Figure 3:
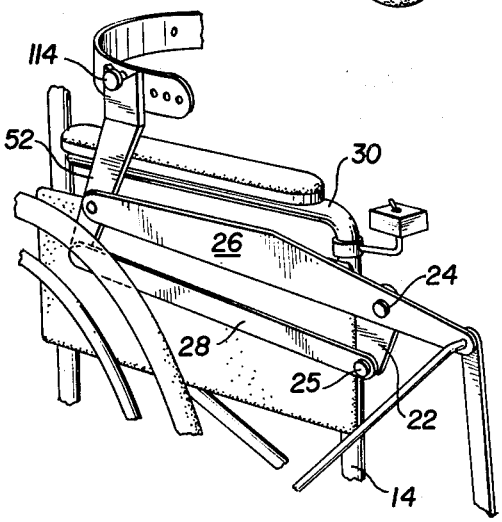
FIG. 3 is a partial front perspective view of an alternate mounting method for the lifting apparatus shown in FIG. 1.

As illustrated in FIG. 3, the operating arms 26 and paralleling arms 28 may be mounted outboard of the wheelchair arm framework 30 in instances where the available space within the wheelchair seating area is insufficient to comfortably accommodate the occupant after subtracting the minimal space required by the subject apparatus. Other embodiments and constructional details of the invention are unaffected by this alternate mode.

Lifting member or brackets generally 52 are rotatably mounted between holes 32 and 34 in operating arms 26 and paralleling arms 28. The mounting holes 53 and 54 in the lifting brackets 52 preferably are substantially the same distance apart as the mounting holes 24 and 25 in pivot plates 22. The lifting brackets 52 preferably are cast or machined from metal or another suitable material and are formed in a configuration like that shown in FIG. 4 which will accomplish their desired functions. As shown in FIG. 4, each lifting bracket 52 comprises a flat rear portion 58 and a a contoured front portion 60 terminating in a top section 62 provided with a recess 64 or other suitable means for receiving or positioning the lifting points of a harness in a manner to be described hereinafter. The top section 62 may be removable from the lower portion of the lifting bracket 52 and inserted into the lower portion of the bracket 52 by pins 66 and sockets 67 or other suitable connecting means.

By substitution of different lengths of top sections such as **62*a* (FIG. 4), the device may be adjusted to accommodate different heights of wheelchair occupants. The distance between the mounting hole 53 in each lifting bracket 52 and the recess 64 in the top portion 62 should be such as to place the recess 64 in a position substantially along the centerline of, and above the center of gravity of the wheelchair occupant. This positioning preferably places the recess 64 above the level of the wheelchair armrest 68 and, in addition, does not interfere with the arm movements of the occupant necessary to propel the wheelchair when the apparatus is in the lowered position shown in FIGS. 1 and 2**.

Ground engaging cams 70, or other suitable means such as wheels are mounted rotatably on the outer ends of the footrest supports 72 through holes 74. Each ground engaging cam 70 may be either stamped, molded or machined of metal or other suitable material and preferably is provided with a low friction plastic or similar pad 78 bonded or otherwise affixed to the curved edge 80 along the portion which comes in contact with the ground 76, as shown in FIG. 2. The ground engaging cams 70 preferably are mounted so that with the operating arms 26 in the lower position of FIG. 2, they provide sufficient ground clearance for the wheelchair 10, and with the operating arms 26 in the raised position shown in broken lines in FIG. 2, they engage the ground 76 along the curved edges 80.

Adjustable cam actuating arms 82, with length adjusting means such as holes or slots and multiple position bolts 83, are rotatably connected to the free end of each of the ground engaging cams 70 and at the hole 86 in the portion of each operating arm 26 which extends forward of the wheelchair 10. The cam actuating arms 82 may be made from metal or any other suitable material.

Lift actuating arms 88 are rotatably connected between holes 86 in the operating arms 26 and the ends of extension arms 90 on actuator gearboxes 91. The actuator gear 91 are mounted on the wheelchair frame 10 by means of mounting plates 92 which are made from metal or any other suitable material and preferably are bolted or otherwise secured to the wheelchair frame 10 in a convenient location.

The actuator greatboxes 91 are powered by means of rotating flexible torque cables 94 or similar means extending from suitable connections at the motor 95. Positive application of force both on the raising and lowering operations are provided by this means.

A battery 96 is mounted at a convenient location on the wheelchair 10. Wiring 98 connects the battery 96 to the motor 95 through a control switch 100 and a pair of limit switches 102 and 104.

Limit switch 102 is provided to turn off the motor 95 when the arms 26, 28 reach the desired upper position shown in broken lines in FIG. 2. Limit switch 104 is provided to turn off the motor 95 when the operating arms 26 reach the desired lower position shown in solid lines in FIG. 2.

It is recognized that a cable system, hydraulic system or other suitable means may be used, either hand-operated or power-assisted to provide motive force for the lifting apparatus of the present invention.

A harness, generally 110, is adapted to be fastened around the wheelchair occupant. The harness 110 may be of any type which will comfortably lift an individual from a seated to a standing position such as safety harnesses in common use in various trades, but preferably embodies the novel features of construction illustrated in FIGS. 10 and 11, and described hereinafter.

As shown in FIGS. 1, 10 and 11, a substantially semicircular rigid brace 112, generally following the contours of the rear portion of the upper torso of the wheelchair occupant, is utilized. A pair of lift points 114 are mounted on the rigid brace 112 which will securely mate with and be lifted by the recesses 64 on the lifting brackets 52 shown in FIG. 4. Fastened to and depending from both sides of the rigid brace 112, preferably in a position slightly in front of the centerline of the occupant, is a main support strap 116 of suitable, preferably flexible web material passing under the body of the occupant at a location just below the buttocks. A padded, widened portion 118 of the strap 116 is disposed along that portion of the strap 116 which passes beneath the occupant. Padded adjustable straps 120 are anchored in a suitable location near the center of the widened portion 118 of the main support strap 116 and pass around the upper thighs of the occupant attaching to rings 122 or similar connectors. The rings 122 are slidably mounted on straps 124 which are attached at one end 126 to the main support strap 116 in the vicinity of the hip. The straps 124 pass through the rings 122 and double back, passing freely through cannels 128 attached to the main support strap 116, and terminate at mounting points 130 near the center of the rigid brace 112. An adjustable belt-like strap 132 passes around the torso at a location preferably just below the rigid brace 112 and above the center of gravity of the wheelchair occupant and freely passes through channels 134, 136, 138 and 140 in the main support strap 116 and straps 124.

Several mounting holes 142 are provided near the ends of the rigid brace 112 for connecting the main support strap 116 thereto. By moving the main support strap 116 closer to or further from the lift points 114, adjustment may be made for differences in the centerline of different individuals so that a comfortable upright position may be achieved.

A plurality of mounting holes 144 are provided in the upper ends of the main support straps 116 and the secondary anchor straps 124. The provision of alternate holes 144 allows for adjustment of the harness for differences in torso length and personal preferences in the location of the cushioned main support strap 116 and leg retaining straps 120 on different individuals.

A contoured seat cushion 146 preferably is provided on the cheelchair 10 as shown in FIG. 1. The cushion 146 is formed with recesses 148 for receiving the lower padded portions 118, 120 of the harness 110 to provide a more comfortable seating surface.

FIG. 6 illustrates a typical fastening system for rotatably connecting the various components of the present lifting apparatus where necessary. In FIG. 6, 180 and 182 are the rotatably connected members which may represent an actuating arm 82 and cam 70, respectively, 184 is a threaded shoulder bushing or T-nut, 188 is a trust bearing or washer, and 190 is a bolt completing the fastening system and providing for rotational connection unaffected by the typical radial or thrust forces present within the apparatus described.

In operation, the occupant of the wheelchair or the like wears the harness 110 and secures it around his torso and upper thighs. While seated upon the contoured cushion 146, unevenness of the setting surface and potential chafe points are minimized, owing to the recesses 148. In addition, the recesses 148 in the cushion 146 serve to initially position the padded portion 118 of the main support strap 116 in the desired location, preferably at the juncture between the upper thighs and buttocks.

Upon activation of the control switch 100, the motor 95 operating through the torque cables 94 powers the actuator gearboxes 91 and the lift actuating arms 88. The lift actuating arms 88 acting upon the operating arms 26 cause the lifting brackets 52 to raise up and engage the lift points 114 on the harness 110. Upon continuing this motion the wheelchair occupant is raised to any point along line 150 to an upright position at point 152 at the front of the wheelchair 10 as shown in broken lines in FIG. 2. The path of lift along line 150 closely approximates the normal knee and hip actions in standing. The action of the paralleling arms 28 and lifting brackets 52 enable the lift along line 150 to a standing position at point 152 to be greater than the lift which would be achieved by use of operating arms 26 alone, and the adjustability of the harness 110 and lifting brackets 52 enable the adjustment of the apparatus to suit any particular individual.

As the wheelchair occupant is raised along line 150 and passes point 154 shown in FIG. 2, the cam actuating arms 82 cause the ground engaging cams 70 to engage the ground 76 with the low friction pads 78. During the remaining portion of the lift from point 154 to the upright position at 152, the ground engaging cams 70 provide a stabilized position for the wheelchair 10 and prevent the weight of the wheelchair occupant from overbalancing the wheelchair 10 and causing it to topple forward.

When the desired upright position at point 152 is reached, the extension arm 90 on the gearbox 91 contacts the limit switch 102 to turn off the power from the battery 96 to the motor 95 and the lifting action ceases.

When the occupant desires to be lowered, the control switch 100 is activated to reverse the rotation of the motor 95. When the desired fully lowered position is reached, the limit switch 104 turns off the power to the motor 95 and the movement ceases. The motor 95 may be manually turned off by means of the switch 100 at any point along the line 150 during raising or lowering. Manual control of the device allows the occupant to raise himself only an inch or two, if desired, to relieve pressure experienced on the spine and buttocks from being constantly confined to a sitting position.

When in the standing position at point 152 in front of the wheelchair 10 complete freedom of arm, head, and upper torso is retained to allow desired movement or activities to be carried on.

When the wheelchair occupant desires to transfer from the wheelchair to a commode, or other alternate seating or sleeping means, the operating arms 26 provide stabilized gripping and supporting points to aid in the transfer safely without attendant assistance.

The adjustable cam actuating arms 82 may be lenghthened if desired by means of relocation of the adjusting bolts 83 to engage the cams 70 on the ground surface 76 and provide added stability. Upon returning to the wheelchair 10, the cam actuating arms 82 are returned to the shortened position by relocation of the adjusting bolts 83 to their former position.

The clearances for maneuvering the traveling of the wheelchair 10 are unaffected by the addition of the lifting apparatus of the present invention, and the apparatus may be removed from the wheelchair 10 if desired by disengaging the pivot plates 22 from the attachment brackets 12, and disconnecting the lift actuating arms 88 and the cams 70 and cam actuating arms 82 at their respective mounting points.

The foldability of the wheelchair 10, should it be of the folding type, is virtually unaffected, after removal of the battery 96, by the present lifting apparatus.

FIGS. 12–15 illustrate a modification which may be made in the fastening system used between the hole 86 in at least one of the operating arms 26, the lift actuating arm 88 and the cam actuating arm 82. In FIG. 12, it is shown that the pivot plate 22, with operating arm 26, paralleling arm 28, and lifting bracket 52 attached, may be removed from the attachment bracket 12 as a unit allowing free access to the wheelchair 10 for entry and exit should it be desired. To accomplish this end in a preferred manner, a special fastening system is shown in FIG. 13 along with details of a preferred construction in FIGS. 14 and 15.

The fastening system, generally 160, is contained within a main body 162. The body 162 of the fastener 160 preferably is fixedly mounted within the hole 86 in at least one of the operating arms 26. A pair of studs 164 and 166 or similar protuberances extend from opposite sides of the body 162. The studs 164 and 166 preferably are provided with a stepped chamber 168 containing a biasing spring 170 and a pair of contoured plungers 172 and 174 which act against balls 176 confined within and slightly protruding from holes 177 in the studs 164 and 166, thereby providing an easily operable quick-disconnect means for the lift actuating arm 88 and cam actuating arm 82.

Pressure on the protruding ends of the contoured plungers 172 and 174 causes the balls 176 to withdraw within the holes 177 in the studs 172 and 174, allowing the easy disconnection of the lift actuating arm 88 and cam actuating arm 82. The arms 88 and 82 may be reinstalled by pressing them over the studs 164 and 166 to cause the balls 176 to withdraw within the studs 164 and 166 and subsequently return to their protruding position by the pressure of the biasing spring 170 after the arms 88 and 82 have come to their desired position on the studs 164 and 166.

It is recognized that, within the scope of the present invention, other suitable disconnectable fastening means may be employed. The system illustrated in FIGS. 12–15 is advantageous, however, because of ease of operation and total lack of easily dropped or misplaced parts, such as nuts and washers, resulting from the loss of manual dexterity experienced by many disabled persons.

For safety reasons, it is preferable to include an electrical interlock in conjunction with a disconnectable fastening for the purpose described herein. As illustrated in FIGS. 14 and 15, a channel 181 is provided within the body 162 of the fastening 160. Protruding from either side of the channel 181 are spring loaded plungers 183 acting internally against a pair of spring-biased electrical contacts 185 and 187. The spring biased contacts 185 and 187 preferably are placed in series with the operating switch 100 or a relay or similar electrical disabling means by leads 189 extending externally of the operating arm 26 through a channel 191 in the operating arm 26 and fastener body 162.

When the lift actuating arm 88 and cam actuating arm 82 are both in their desired position on studs 164 and 166, the contacts 185 and 187 are closed to allow operation of the motor 95. When either or both of the arms 88 and 82 are not in their desired position on studs 164 and 166, the contacts 185 and 187 leave the circuit open to prevent operation of the motor 95. This safety mechanism prevents inadvertent operation of the lifting system in a potentially hazardous or incomplete mode.

Figures 7, 8, 9:
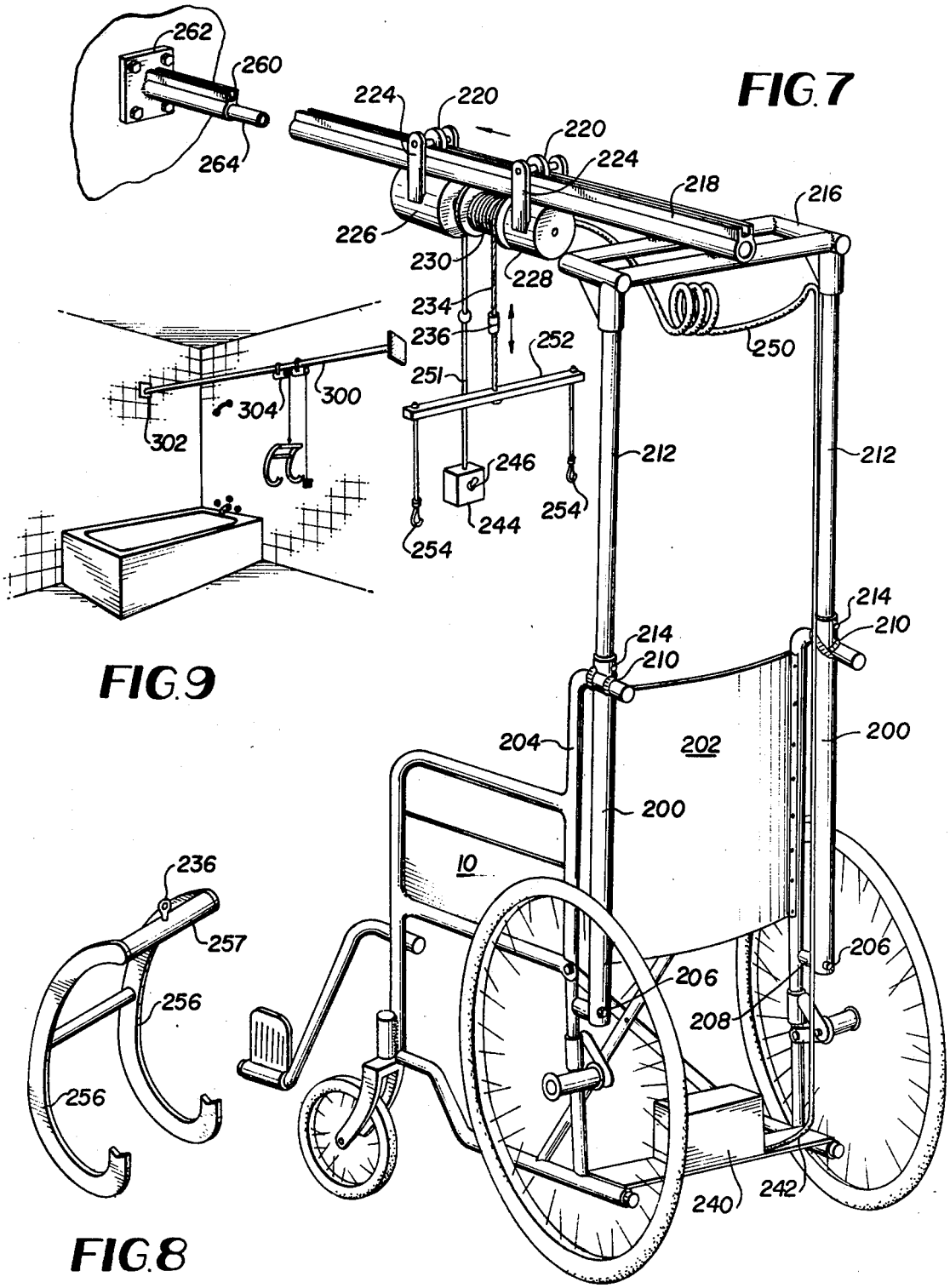
FIG. 7 is a rear perspective view of a modified lifting apparatus of the present invention.
FIG. 8 is a perspective view of an alternate lifting bracket for the apparatus shown in FIG. 7.
FIG. 9 is a perspective view of a wall mounted lifting system in accordance with the present invention.

A second embodiment of lifting apparatus compatible with the harness 110 is shown in FIG. 7 for use in cases where the configuration of the wheelchair, personal preference or some other consideration make an overhead lifting device desirable or useful.

This alternate lifting apparatus comprises a wheelchair 10 with a pair of support posts 200 secured behind the back sling 202 to the rear support frame 204 by means of bolts 206 and spacers 208 or clamps 210. Care should be taken in the mounting position of the support posts 200 to avoid interference with the body of the wheelchair occupant or the deformation of the back sling 202 when the occupant is seated. The support posts 200 preferably are made from metal pipe or tubing of a circular or other suitable cross section. Extension sections 212, preferably made from the same materials as the support posts 200, are telescopically or otherwise fitted to the support posts 200 and secured in the desired positions by bolts 214 or other suitable locking means.

A rigid framework 216, preferably of lightweight metal, is fitted telescopically over the extension sections 212 of the support posts 200. A rail or channel 218 of structural shape made from a metal extrusion or other suitable material is welded or otherwise rigidly mounted to the rigid framework 216 generally along the centerline of the wheelchair 10 and extending toward the front at a suitable height so as to be above the head of the wheelchair occupant when in a standing position.

Wheels 220 or rollers are engaged within the rail or channel 218 and a winch assembly is suspended below the wheels 220 by means of a support frame 224.

The winch assembly comprises a motor 226 which is battery operated and reversible, a gear reduction assembly 228 and a cable drum 230 along with a suitable cover (not shown) shielding the operating mechanisms from view. A cable 234 depends from the cable drum 230 and preferably terminates in a swivel fastening 236.

A second motor (not shown) may be utilized if desired to operate the wheels 220 in forward and reverse directions. A battery 240 and battery carrier 242 may be mounted in any convenient location beneath or on the wheelchair 10.

A control box 244 containing a switch 246 controlling the winch motor 226 along with power cables 250 complete the device attached to the wheelchair 10. The control box 244 is mounted in a convenient location and preferably is demountable and equipped with an extendible control cable 251.

Ground engaging cams (not shown) similar to the cams 70 described previously in the disclosure may be added if desired.

A spreader bar 252 with a pair of cables 254 may be attached between the swivel fastening 236 and the lift points 114 on the harness 110 shown in FIGS. 10 and 11. Alternately, as shown in FIG. 8, a pair of C-shaped brackets 256, mounted on a spreader bar 257 made from metal or other rigid material, may be fastened to the swivel fastening 236 and pick up on the lift points 114 on the harness.

An extension rail 260 of the same cross section as the rail 218 may be welded or otherwise secured to a bracket 262 and affixed to a wall or other desired location. The extension rail 260 preferably includes an extended postion 264 which telescopically mates with the rail 218 on the wheelchair 10 to jointly provide a rigid transport rail for movement between the wheelchair 10 and an alternate location such as a bed, a second chair, a bathtub or the like.

This overhead lifting system is particularly advantageous when situations are encounted in which turning and swiveling are required such as entering a bed or bathtub.

Should folding of the wheelchair 10 be desired for storage or transport, the rigid framework 216 and extension sections 212 of the support posts 200 may be quickly demounted, the battery 240 and battery mount 242 removed, and the wheelchair 10 returned to its original condition, except for the support posts 200 mounted to the rear support frame 204.

A final device compatible with the harness 110 is herein described suitable for mounting in semi-permanent locations such as bathrooms, bedrooms, garages or the like for ease of movement from or to the wheelchair and other frequently used locations. As shown in FIG. 9, a rail section 300 is connected to brackets 302 which are affixed to opposite walls or other suitable locations. A traveling winch assembly 304, substantially the same as that shown in FIG. 7, with the exception of the preferable use of commercial rather than battery power, is mounted on the rail section 300. Lifting attachments substantially the same as disclosed in FIGS. 7 and 8 may be employed to engage the lift points on the harness 110 for transfer of the wheelchair occupant to alternate locations such as a toilet, bathtub, bed or automobile without the aid of attendants. In utilizing this lifting system the wheelchair 10 is completely unincumbered by lifting systems, batteries, or other weight adding accessories which would increase the effort required for self-propulsion.

What is claimed is:

1. In a wheelchair or the like having a frame and a seat portion connected to said frame, the improvement comprising:

harness means adapted to support an occupant of the wheelchair, and means operatively connected to said frame and to said harness means for moving said harness means between a lower position adjacent said seat portion and an upper position spaced from said seat portion, said moving means comprising a linkage pivotally connected to said frame and power means mounted on said frame and connected to said linkage for moving it relative to said frame, said linkage being provided with a lifting member having a lifting bracket at the free end of said linkage that is engagable with said harness means for moving same, whereby an occupant of the wheelchair may be lifted upwardly to a position spaced above said seat portion by said harness means and said moving means.

2. The wheelchair of claim 1 wherein said harness means is adapted to fit around the lower torso of the occupant in an area between the hips and rib cage of the occupant.

3. The wheelchair of claim 2 wherein said harness means is adapted to engage the buttocks and thigh area of the occupant during upward movement thereof.

4. The wheelchair of claim 2 wherein the seat portion is recessed to accommodate the lower portion of the harness means when in said lower position, thereby providing a substantially uniform and comfortable seating surface for the occupant wearing said harness in a seated position.

5. The wheelchair of claim 1 wherein said lifting bracket is provided with a recess at its upper end and said harness means is provided with an extension adapted to be seated in said recess.

6. The wheelchair of claim 1 wherein the upper portion of said lifting bracket is adjustable to vary the height of said recess.

7. The wheelchair of claim 1 wherein said linkage further comprises a pair of substantially parallel arms pivotally connected at one end to said lifting bracket, and a pivot plate mounted on the upper forward portion of said frame and being pivotally connected to said parallel arms near the other end thereof.

8. The wheelchair of claim 1 wherein said pivot plate is releasably mounted on said frame.

9. The wheelchair of claim 1 wherein the other end of one of said arms extends beyond the other arm, a cam actuating arm is pivotally connected at its upper end of said other end of said one arm, and a ground-engaging cam member is pivotally connected at one end to the lower end of said cam actuating arm, said cam member being pivotally connected at its other end to the lower forward portion of said frame.

10. The wheelchair of claim 1 wherein a lift actuating arm is pivotally connected at one end to said other end of said one arm and to the upper end of said cam actuating arm, and said power means is operatively connected to the other end of said actuating arm for effecting movement of said linkage and said harness means.

11. The wheelchair of claim 1 comprising means to limit the operation of said power means to control the upper and lower positions of said harness means.

12. The wheelchair of claim 1 wherein said cam member is releasably connected to said frame.

13. The wheelchair of claim 1 wherein the length of said cam actuating arm is adjustable.

14. The wheelchair of claim 1 wherein said cam member is pivotable relative to said frame between a first position raised from the ground surface when said harness means is in said lower position and a second position in engagement with the ground surface in front of the wheelchair when said harness means is in said upper position, thereby to prevent the wheelchair from tipping forwardly when said harness means is in said upper position.

15. The wheelchair of claim 1 comprising means adapted to prevent forward tipping of the wheelchair when said harness means is in said upper position.

16. The wheelchair of claim 15 wherein said tipping preventing means is connected to said moving means and is adapted to engage the ground surface in front of the wheelchair when said harness means is moved to said upper position.

17. The wheelchair of claim 1 wherein said linkage comprises a cable connected to said lifting member, rail means connected to said frame and extending forwardly thereof above said seat portion, and winch means movably mounted on said rail means, said winch means serving to raise and lower said cable and said harness means.

18. The wheelchair of claim 17 wherein said cable is connected to a spreader bar having a pair of depending second cables connected to said lifting member.

19. The wheelchair of claim 18 wherein said cable is connected to said spreader bar by a swivel fastening means.

20. The wheelchair of claim 17 wherein said lifting member comprises a spreader bar having a pair of depending brackets terminating in upwardly facing ends having recesses therein, and said harness means comprises a pair of extensions adapted to be seated in said recesses.

21. A harness for supporting a person and adapted to fit around the lower torso in an area between the hips and rib cage of the person, said harness comprising:

a substantially semi-circular rigid brace member generally following the contours of the rear portion of the upper torso of a person, a first support strap secured at its ends to the end portions of said brace member, said first strap being adapted to pass under the body of a person at a location just below the buttocks;

a pair of second straps secured at one end thereof to the lower center portion of said first strap and extending forwardly and upwardly therefrom, said second straps being adapted to pass around the upper thighs of a person, a pair of third straps secured to and extending downwardly from said brace member to the lower side portions of said first strap on opposite sides of the harness, means adjustably connecting the other ends of said second straps to portions of said third straps intermediate the ends thereof, and belt means adapted to extend around the torso of a person at a location below said brace member, said belt means being supported by said first strap and said third straps.

22. The harness of claim 21 wherein the lower portion of said first strap and substantially the entire lengths of said second straps are padded.

23. The harness of claim 21 wherein said first strap and said third straps are provided with channels through which said belt means passes.

24. The harness of claim 21 wherein said first strap is provided with channels in the side portions thereof, and said third straps pass through said channels.

25. The harness of claim 21 wherein the ends of said first strap and the upper ends of said third straps are adjustably connected to said brace member.

* * * * *